US006719889B2

(12) United States Patent
Brown

(10) Patent No.: US 6,719,889 B2
(45) Date of Patent: Apr. 13, 2004

(54) CATHODE FOR ALUMINUM PRODUCING ELECTROLYTIC CELL

(75) Inventor: Craig W. Brown, The Dalles, OR (US)

(73) Assignee: Northwest Aluminum Technologies, Seattle, WA (US)

( * ) Notice: Subject to any disclaimer, the term of this patent is extended or adjusted under 35 U.S.C. 154(b) by 93 days.

(21) Appl. No.: 10/126,104

(22) Filed: Apr. 22, 2002

(65) Prior Publication Data

US 2003/0196910 A1 Oct. 23, 2003

(51) Int. Cl.[7] ..... C25C 3/06; C25C 3/08; C25C 3/12; B25D 59/40

(52) U.S. Cl. ..... 205/230; 205/385; 205/394; 205/396; 204/243.1; 204/290.01; 204/291

(58) Field of Search ..... 205/230, 372, 205/385, 394, 396; 204/243.1, 290.01, 291

(56) References Cited

U.S. PATENT DOCUMENTS

| | | | | |
|---|---|---|---|---|
| 4,243,502 A | | 1/1981 | Kugler | 204/243 |
| 4,376,029 A | | 3/1983 | Joo 'et al. | 204/294 |
| 4,439,382 A | | 3/1984 | Joo'et al. | 24/29.5 |
| 4,456,519 A | | 6/1984 | Zöllner | 204/290 |
| 4,465,581 A | | 8/1984 | Juel et al. | 204/290 |
| 4,478,693 A | | 10/1984 | Ray | 204/64 |
| 4,492,670 A | | 1/1985 | Mizrah et al. | 419/9 |
| 4,592,812 A | | 6/1986 | Beck et al. | 204/67 |
| 4,865,701 A | | 9/1989 | Beck et al. | 204/67 |
| 5,006,209 A | | 4/1991 | Beck et al. | 204/67 |
| 5,129,998 A | | 7/1992 | Tabereaux et al. | 204/67 |
| 5,217,583 A | | 6/1993 | Sekhar et al. | 204/67 |
| 5,227,045 A | * | 7/1993 | Townsend | 205/230 |
| 5,284,562 A | | 2/1994 | Beck et al. | 204/243 |
| 5,527,442 A | | 6/1996 | Sekhar et al. | 204/243 |
| 5,538,604 A | | 7/1996 | Keller et al. | 204/243 |
| 5,961,811 A | | 10/1999 | Keller et al. | 204/247.4 |

OTHER PUBLICATIONS

Brown, "Laboratory Experiments with Low–Temperature Slurry–Electrode Alumina Reduction Cells", Presented at the 2000 TMS Annual Meeting, Nashville, Tennessee, Mar. 12–Mar. 15, 2000 pp. 391–396.

* cited by examiner

*Primary Examiner*—Donald R. Valentine
(74) *Attorney, Agent, or Firm*—Andrew Alexander

(57) ABSTRACT

A method of producing aluminum in an electrolytic cell comprising the steps of providing an anode in a cell, preferably a non-reactive anode, and also providing a cathode in the cell, the cathode comprised of a base material having low electrical conductivity reactive with molten aluminum to provide a highly electrically conductive layer on the base material. Electric current is passed from the anode to the cathode and alumina is reduced and aluminum is deposited at the cathode. The cathode base material is selected from boron carbide, and zirconium oxide.

22 Claims, 1 Drawing Sheet

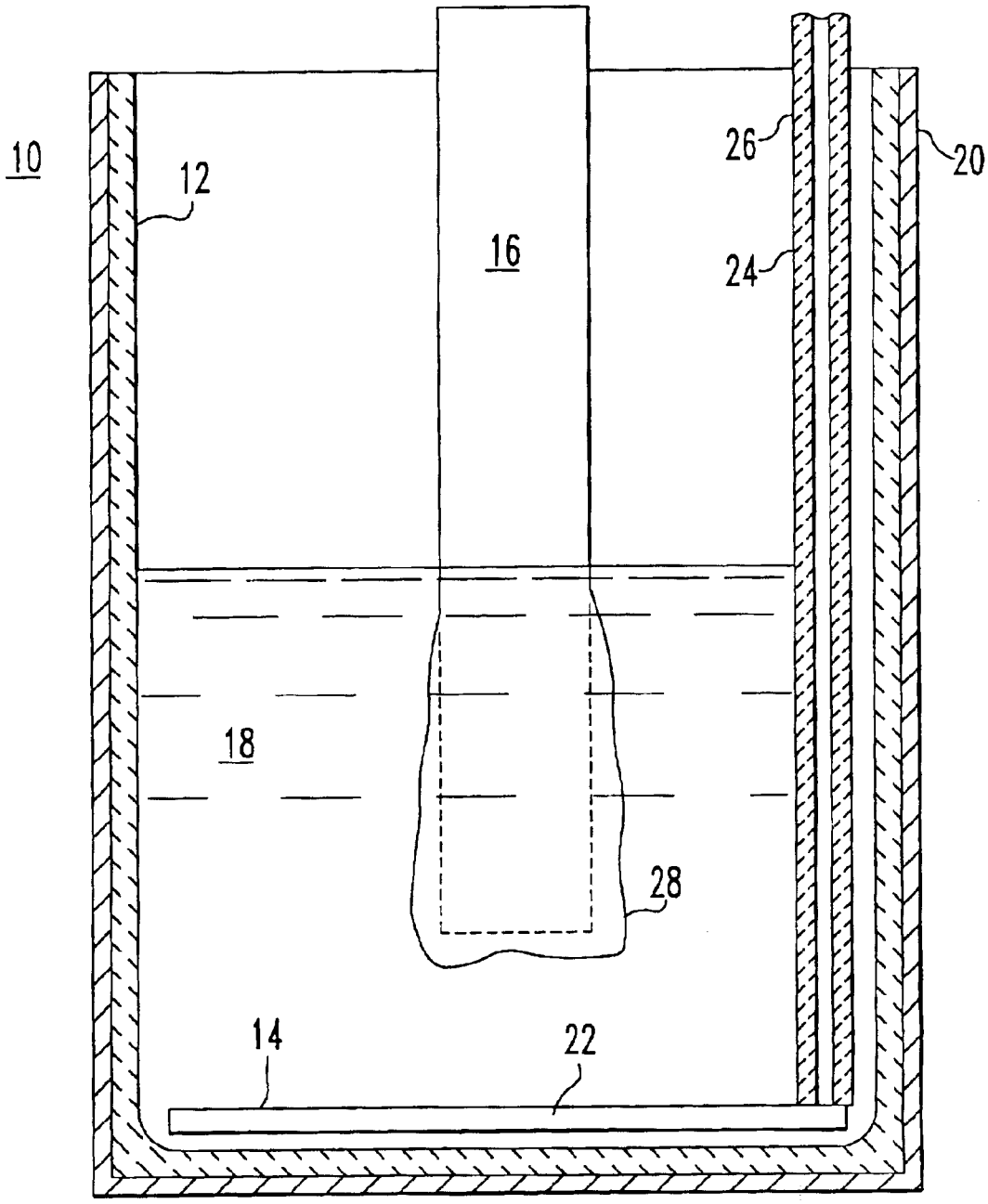
10
12
16
26
20
24
18
28
14
22

CATHODE FOR ALUMINUM PRODUCING ELECTROLYTIC CELL

The government has rights in this invention pursuant to Contract No. DE-FC07-00ID13901 awarded by the Department of Energy.

BACKGROUND OF THE INVENTION

This invention relates to electrolytic production of aluminum and more particularly, it relates to an improved cathode suited for use in a low temperature electrolytic cell for the production of aluminum.

In the electrolytic production of aluminum, there is great interest in utilizing a cathode that is highly conductive and does not react with molten aluminum deposited thereon. Carbon cathodes which are traditionally used in the Hall-Heroult cells have the problem that they are not readily wettable with molten aluminum. The carbon cathode surface reacts with the molten aluminum and forms aluminum carbide. Thus, the cathode is depleted at about 2 to 5 cm/yr. during operation of the cell. Or, the carbon cathode has the problem that it permits formation of cyanides, presenting a disposal problem. Thus, the carbon cathode has been replaced or modified with materials to improve its performance.

For example, U.S. Pat. No. 5,961,811 discloses an improved carbonaceous material suitable for use as a cathode in an aluminum producing electrolytic cell, the cell using an electrolyte comprised of sodium containing compounds. The carbonaceous material is comprised of carbon and a reactive compound capable of suppressing the formation or accumulation of sodium cyanide during operation of the cell, of reacting with sodium to reduce problems associated with sodium intercalation, and of reacting with one of titanium or zirconium to form titanium or zirconium diboride during operation of the cell to produce aluminum.

U.S. Pat. No. 5,217,583 discloses electrodes suitable for electrochemical processing which are a preferred product form, particularly electrodes for use in the electrowinning of aluminum from its oxide. According to the patent, such products are comprised of a dimensionally stable combustion synthesis product of a composition containing at least 20% by weight of a particulate combustible material; at least 15% by weight of a particulate filler material capable of providing desired mechanical and electrical properties; and up to 35% by weight of a particulate inorganic binder having a melting point lower than the combustion synthesis temperature.

U.S. Pat. No. 4,243,502 discloses a wettable cathode for an electrolytic cell for the electrolysis of a molten charge, in particular for the production of aluminum, where the said cathode comprises individual, exchangeable elements each with a component part for the supply of electrical power. The elements are connected electrically, via a supporting element, by molten metal which has separated out in the process. The interpolar distance between the anodes and the vertically movable cathode elements is at most 2 cm.

U.S. Pat. No. 4,376,029 discloses a cathode component for a Hall aluminum cell which is economically produced from a mixture of a carbon source, preferably calcined petroleum coke, and optionally calcined acicular needle petroleum coke, calcined anthracite coal; a binder such as pitch including the various petroleum and coal tar pitches; titanium dioxide, $TiO_2$; and boric acid, $B_2O_3$ or boron carbide, $B_4C$; forming said mixture into shapes and heating to a $TiB_2$-forming temperature.

U.S. Pat. No. 4,439,382 discloses that titanium diboride graphite composite articles are produced by mixing $TiO_2$, petroleum coke and a binder to form a plastic dispersion. Articles are shaped by molding or extrusion and baked to carbonize the binder to form a baked carbon-$TiO_2$ composite. The article is impregnated with a molten or dispersed boron compound, then heated to drive $TiB_2$ forming reaction. The article is then further heated to a graphitizing temperature to form a graphite-$TiB_2$ composite useful as a cathode component in a Hall aluminum reduction cell.

U.S. Pat. No. 4,456,519 discloses an electrode made of a number of elongated elements which are plates, rods or tubes. The elements are composed of inorganic conductive fibers embedded in a solid, electrochemically active material. The fibers are oriented in the direction of current flow.

U.S. Pat. No. 4,465,581 discloses that $TiB_2$-graphite composite articles suitable for use as cathode components in a Hall aluminum reduction cell are made by impregnating a $TiO_2$-carbon composite with a boron compound and carbon black dispersed in water, or alternately by impregnating a boron or boron compound-carbon composite with a carbon black-$TiO_2$ dispersion, and heating the article to a reaction temperature whereby $TiB_2$ is formed and the amorphous carbon converted to graphite. The article may be impregnated with a carbonizable liquid, re-baked, and re-heated to a graphitizing temperature to increase its strength and density.

U.S. Pat. No. 4,478,693 discloses an inert type electrode composition suitable for use in the electrolytic production of metals such as aluminum. The aluminum is produced from an aluminum-containing material dissolved in a molten salt. The electrode composition is fabricated from at least two metals or metal compounds combined to provide a combination metal compound containing at least one of the group consisting of oxide, fluoride, nitride, sulfide, carbide or boride.

U.S. Pat. No. 5,129,998 discloses that the density of various refractory hard metal articles are controlled so that articles made from the refractory hard metals are able to float on the surface of molten aluminum. Floating such articles on aluminum has been found to both stabilize and protect the surface of molten aluminum. Floating cathodes for use in aluminum reduction cells is a particular application for the floating refractory hard metals.

U.S. Pat. No. 5,527,442 discloses a carbonaceous, refractory or metal alloy substrate material coated with a refractory material, the refractory material including at least one of borides, silicides, nitrides, aluminides, carbides, phosphides, oxides, metal alloys, inter-metallic compounds and mixtures of one of titanium, chromium, zirconium, hafnium, vanadium, silicon, niobium, tantalum, nickel, molybdenum and iron and at least one refractory oxide of rare earth metals. An aluminum production cell including a component made up of a material coated with the coating described above is also disclosed.

U.S. Pat. No. 5,538,604 discloses an improved carbonaceous material suitable for use as a liner in an aluminum producing electrolytic cell, the cell using an electrolyte comprised of sodium containing compounds and the carbonaceous material penetrable by sodium or nitrogen and resistant to formation or accumulation of sodium cyanide during operation of the cell. The carbonaceous material is comprised of carbon and a reactive compound capable of reacting with one of sodium, nitrogen and sodium cyanide during operation of the cell to produce aluminum, the reactive compound present in an amount sufficient to suppress formation or accumulation of cyanide compounds in the liner.

U.S. Pat. No. 5,006,209 discloses that cathodes for use in low temperature cells 660° to 800° C. are typically composed of an electrically conductive, refractory hard metal which is wet by molten aluminum and stands up well in the bath under operating conditions and that the preferred cathode material is titanium diboride. U.S. Pat. No. 4,865,701 discloses that other useful cathode materials include titanium carbide, zirconium carbide, zirconium diboride, niobium diboride, tantalum diboride and combinations of said diboride in solid solution form, e.g., (Nb, Ta)$B_2$.

In spite of these disclosures, there is still need for an improved cathode suitable for use in an electrolytic cell for producing aluminum.

SUMMARY OF THE INVENTION

It is an object of the invention to provide an improved cathode for use in an electrolytic cell for reducing alumina to aluminum in a molten salt.

It is another object of the invention to provide a cathode comprised of a base material having high electrical resistivity for use in an electrolytic cell for reducing alumina to aluminum in a molten salt.

It is yet another object of the invention to provide a composite cathode comprised of a base material having high electrical resistivity and having a layer thereon wettable with aluminum.

Still, it is another object of the invention to provide a composite cathode comprised of a boron carbide or zirconium dioxide base material and a layer wettable with molten aluminum.

Yet another object of the invention is to provide a cathode comprised of a base material having high electrical resistivity for use in a low temperature electrolytic cell for reducing alumina to aluminum in a molten salt.

Still it is another object of the invention to provide a cathode comprised of a base material having high electrical resistivity suitable for reaction with molten aluminum to provide an aluminum wettable layer for use in an electrolytic cell for reducing alumina to aluminum in a molten salt.

These and other objects will become apparent from a reading of the specification and claims and an inspection of the drawings appended hereto.

In accordance with these objects, there is provided a method of producing aluminum in an electrolytic cell comprising the steps of providing an anode in a cell, preferably a non-reactive anode, and also providing a cathode in the cell, the cathode comprised of a base material having high electrical resistivity, e.g., higher than about 0.1 ohm-cm (DC) at 25° C. and reactive with molten aluminum to provide an aluminum wettable layer on the base material. Electric current is passed from the anode to the cathode and alumina is reduced and aluminum is deposited at the cathode. The cathode base material is selected from boron carbide, and zirconium oxide.

The electrolyte preferably is a low temperature electrolyte, preferably molten at less than 900° C. When the base material is boron carbide, molten aluminum is reactive therewith to form a layer containing aluminum boride wettable with molten aluminum. Preferably, the anode is an inert anode comprised of CuNiFe or a combination of metal compound and a metal, e.g., metal oxide and metal. The cathode can be prepared by providing a base material having low electrical conductivity such as boron carbide and contacting or reacting a surface of the base material to provide a layer such as aluminum boride wettable with molten aluminum. The layer may be formed by dipping the base material in molten aluminum. This permits low electrically conductive material having high stability in molten aluminum to function as a cathode.

BRIEF DESCRIPTION OF THE DRAWINGS

FIG. 1 is a cross-sectional view of a test cell employed in testing the cathode of the invention.

DETAILED DESCRIPTION OF PREFERRED EMBODIMENTS

Referring now to FIG. 1, there is shown a laboratory, electrolytic cell 10 for use in electrolytically reducing alumina to aluminum, in accordance with the invention. Cell 10 is comprised of an alumina crucible 12 containing an anode 14 and a cathode 16. An electrolyte 18 also is provided in cell 10. Alumina crucible 12 is positioned within a stainless steel container 20. The inner surface of container 20 and outer surface of the sidewall of crucible 12 are provided in abutting relationship (see FIG. 1).

Anode 14 is provided in the form of a disc covering bottom 22 of crucible 12. A vertical copper conductor 24 has a lower end thereof connected to disc 14 and upper end thereof connected to a source of electrical current. In FIG. 1, conductor 24 is covered with alumina tube 26 to confine the electrolysis current to anode disc 14. Cathode 16 is also connected to the source of electric current. For purposes of performing tests, cell 10 is placed in a furnace and held at a temperature at which electrolyte 18 is molten, for example, 680° to 800° C. The temperature of electrolyte 18 may be measured continuously using a chromel-alumel thermocouple contained in a closed-end fused alumina tube.

The electrolytic cell can have an operating temperature less than 900° C. Further, electrolytes that can be employed in the cell can comprise NaF and $AlF_3$ eutectics, KF and $AlF_3$ eutectic and LiF. The electrolyte can contain 6 to 26 wt. % NaF, 7 to 33 wt. % KF, 1 to 6 wt. % LiF and 60 to 65 wt. % $AlF_3$. More broadly, the cell can employ electrolytes that contain one or more alkali metal fluorides and at least one metal fluoride, e.g., aluminum fluoride, and use a combination of fluorides as long as such baths or electrolytes operate at less than about 900° C. For example, the electrolyte can comprise NaF and $AlF_3$. That is, the bath can contain 62 to 53 mol. % NaF and 38 to 47 mol. % $AlF_3$. Examples of electrolytes are described in detail in U.S. Pat. Nos. 5,006,209 and 5,284,562, incorporated herein by reference.

While any inert anode including cermets or metal alloys may be used in an electrolytic cell in combination with the cathode of the invention, it is preferred that the anode material be comprised of Cu—Ni—Fe compositions that have resistance to reaction with the electrolyte. Suitable anode compositions are comprised of 25 to 70 wt. % Cu, 15 to 60 wt. % Ni and 1 to 30 wt. % Fe. Within these limits, a preferred anode composition is comprised of 35 to 70 wt. % Cu, 25 to 48 wt. % Ni, and 2 to 17 wt. % Fe, with typical compositions comprising 45 to 70 wt. % Cu, 28 to 42 wt. % Ni, and 13 to 17 wt. % Fe.

In the process of the invention, alumina is added to the cell on a continuous basis to ensure a regulated supply of alumina during electrolysis. In low temperature cells, alumina has a lower solubility level than in conventional Hall-type cells operated at much higher temperature. In the cell described herein, alumina can be maintained at alumina saturation or above with the cell capable of operating with a slurry electrolyte having up to about 30 wt. % alumina.

Alumina useful in the process can be any alumina that is comprised of finely divided particles and the alumina particle size can range from about 1 to 100 $\mu$m, with the smaller particles being used for ease of dissolution.

Typically, the cell can be operated at a current density in the range of 0.1 to 1.5 A/cm$^2$ while the electrolyte is maintained at a temperature in the range of about 660° to 800° C. A preferred current density is in the range of about 0.4 to 0.6 A/cm$^2$.

The cell and method of operating the cell are set forth in U.S. Pat. No. 5,284,562 and in a paper entitled "Laboratory Experiments With Low-Temperature Slurry-Electrolyte Alumina Reduction Cells", Light Metals 2000 (2000), p. 391, incorporated herein by reference as if specifically set forth.

Cathode 16 is comprised of a base material selected from the group consisting of boron carbide, and zirconium dioxide. Typically, such materials have a high electrical resistivity, e.g., greater than 0.1 ohm-cm, and in the range of 0.1 ohm-cm to about $10^{12}$ ohm-cm. To function as cathodes in an electrolytic cell where alumina is reduced to aluminum, the base materials are required to be wetted by molten aluminum at the cell operating temperature or be reactive with molten aluminum to form a reactive layer on the base material wettable by molten aluminum. The layer of molten aluminum wetting the electrical conductivity base material or reactive layer provides a highly electrically conductive layer which conducts current and thus permits the base material to function as an effective cathode. The preferred base material is boron carbide. Base materials such as boron carbide have the advantage that they are stable in molten aluminum. By the term "highly electrical conductive" is meant that the layer may have a resistivity of less than about 50 $\mu\Omega$·cm and typically in the range of 2 to 30 $\mu\Omega$·cm.

Prior to using cathode 16 in an electrolytic cell, it should be first treated to provide a thin layer of aluminum on the base material to provide for pre-wetting. For example, the layer of aluminum can be provided on the base material by dipping or immersing the cathode in molten aluminum. To avoid thermal shock, the cathode may be pre-heated before immersion. Time of immersion can be a few seconds to a few minutes, e.g., 2 seconds to over 10 minutes. The temperature of the molten aluminum can range from 660° to 1000° C. It should be understood that any method can be used to apply a layer of aluminum on the base material constituting the cathode and includes flame spraying, or dipping through flux.

After coating the base material with aluminum, cathode 16 is immersed in the electrolyte in an electrolytic cell for producing aluminum. In the cell illustrated in FIG. 1, during electrolysis, molten aluminum 28 collects on cathode 16.

While not wishing to be held to any theory of invention, in the case of boron carbide, the wetted cathode may comprise three layers in which the base material constitutes a first layer. When the base material is immersed in molten aluminum, a wettable reaction layer forms such as aluminum boride. The aluminum boride is wettable with molten aluminum providing the third layer which is the active cathode during electrolysis. Thus, it is imperative that bus bar must contact the third layer to provide for electrical conductivity through the cell While reference is made herein to boron carbide base material, it should be understood that the cathode base material can comprise a composite of, for example, boron carbide and other refractory material. The composite may be constituted of, for example, sufficient boron carbide to provide a molten aluminum wettable surface.

A boron carbide cathode in accordance with the invention was tested in the electrolytic cell of FIG. 1. A sample of boron carbide, semi-circular in shape, with radius about 1.5 in., chord length about 2 in., thickness about ⅛ in., and surface area about 10.91 cm$^2$, was fastened to a length of copper tubing. The sample was preheated and then immersed in molten aluminum at 760° C. for about 60 seconds. After removal from the molten aluminum, the sample was coated or wetted with a thin layer of molten aluminum. The cathode was positioned in a 10 ampere test cell, as shown in FIG. 1. The cell contained low temperature electrolyte comprised of about 250 grams of a two-component NaF/$AlF_3$ eutectic composition. The electrolyte and metal anode were heated to 760° C. The coated cathode was heated external to the cell before being positioned in the molten electrolyte. The copper lead of the cathode was connected to an electrolysis power supply. A current of 3.64 amps was applied to the cell at a current density of 0.33 amps/cm$^2$ for a period of 2 hours, then current was increased to 5.64 A for another hour. During this period, cell voltage was measured and overall averaged 3.37 V. After 3 hours, the cell was disassembled and based on the amount of aluminum recovered, an overall current efficiency of 83% was obtained. Thus, the pre-wetted boron carbide was found to serve as a cathode in an electrolytic cell for producing aluminum from alumina.

Having described the presently preferred embodiments, it is to be understood that the invention may be otherwise embodied within the scope of the appended claims.

What is claimed is:

1. A method of producing aluminum in a low temperature electrolytic cell comprising the steps of:

(a) providing a molten electrolyte at temperature less than 900° C. in an electrolytic cell having alumina dissolved in said electrolyte;

(b) providing a substantially non-reactive anode in said cell;

(c) providing a cathode in said cell, the cathode comprised of a base material having a high electrical resistivity and reactive with molten aluminum to provide a layer on said base material wettable with molten aluminum;

(d) passing electric current from said anode through said electrolyte to said cathode; and (e) reducing said alumina and depositing aluminum on said cathode.

2. The method in accordance with claim 1 wherein said base material is a material selected from the group consisting of boron carbide, and zirconium dioxide.

3. The method in accordance with claim 2 including maintaining the electrolyte molten at a temperature range of about 660° to 800° C.

4. The method in accordance with claim 1 including using an electrolyte comprised of at least one or more alkali metal fluorides and at least one other metal fluoride.

5. The method in accordance with claim 1 including using an electrolyte comprised of NaF and $AlF_3$ eutectic, KF and $AlF_3$ eutectic and LiF.

6. The method in accordance with claim 1 including using an electrolyte comprised of 42 to 46 mol. % $AlF_3$ and 54 to 58 mol. % NaF.

7. The method in accordance with claim 1 wherein said anode is a Ni—Fe—Cu anode.

8. The method in accordance with claim 1 wherein said base material is comprised of boron carbide.

9. The method in accordance with claim 1 wherein said base material has a resistivity of greater than 0.1 ohm-cm.

10. A method of producing aluminum in an electrolytic cell comprising: (a) providing a molten electrolyte in an electrolytic cell having alumina dissolved therein;

(b) providing an anode and a cathode in said electrolyte in said cell, said cathode comprised of:

(i) a base material comprised of boron carbide:

(ii) a layer of aluminum carbide on said base material, said layer formed by reacting aluminum with said boron carbide in said base material, said aluminum carbide layer wettable with molten aluminum; and (iii) a layer of aluminum provided on said layer of aluminum carbide;

(c) passing electric current from said anode through said electrolyte to said cathode; and (d) reducing said alumina and depositing aluminum on said cathode.

11. A method of producing aluminum in a low temperature electrolytic cell comprising the steps of:

(a) providing molten electrolyte at a temperature range of 660° to 800° C. in an electrolytic cell having alumina dissolved in said electrolyte;

(b) providing a substantially inert anode in said electrolyte;

(c) passing electric current from said anode through said electrolyte to a cathode immersed in said electrolyte, the cathode comprised of a boron carbide base material reactive with molten aluminum providing a reactive layer on said base material wettable by molten aluminum provided as a layer on the reactive layer; and (d) reducing said alumina and depositing aluminum on the cathode.

12. The method in accordance with claim 11 wherein said base material is a material selected from the group consisting of boron carbide, and zirconium dioxide.

13. The method in accordance with claim 11 including using an electrolyte comprised of NaF and $AlF_3$ eutectic, KF and $AlF_3$ eutectic and LiF.

14. The method in accordance with claim 11 including using an electrolyte comprised of 42 to 46 mol. % $AlF_3$ and 54 to 58 mol. NaF.

15. A method of preparing a cathode for use in the production of aluminum in an electrolytic cell employing a molten electrolyte having alumina dissolved therein comprising:

(a) providing a base material comprised of boron carbide; and (b) contacting a surface of the base material with aluminum to provide a coating of aluminum thereon that reacts with said surface when said aluminum is molten.

16. The method in accordance with claim 15 wherein said coating of aluminum is provided by immersing said base material in molten aluminum.

17. The method in accordance with claim 15 wherein said coating of aluminum is provided by flame spraying.

18. A method of forming a boron carbide based cathode for use in the production of aluminum in a molten electrolyte having aluminum dissolved therein comprising:

(a) providing a base material comprised of boron carbide; and (b) reacting said base material with aluminum to form a layer thereon containing aluminum boride wettable with molten aluminum.

19. The method in accordance with claim 18 including reacting said base material with aluminum at a temperature of greater than 600° C.

20. A refractory composite cathode for use in an aluminum producing electrolytic cell, said cell employing a molten electrolyte containing alumina dissolved therein, the cathode comprised of:

(a) base material having high electrical resistivity; and (b) a layer of an aluminum compound provided on said base material to provide a layer thereon wettable with molten aluminum.

21. The cathode in accordance with claim 20 wherein said base material is comprised of a material selected from the group consisting of boron carbide, and zirconium dioxide.

22. The cathode in accordance with claim 20 wherein said base material is boron carbide and said aluminum compound comprises aluminum boride.

* * * * *